US006419759B1

(12) United States Patent
Yang et al.

(10) Patent No.: US 6,419,759 B1
(45) Date of Patent: Jul. 16, 2002

(54) MULTIELEMENT INTERSTITIAL HARD MAGNETIC MATERIAL AND PROCESS FOR PRODUCING MAGNETIC POWDER AND MAGNET USING THE SAME

(75) Inventors: Yingchang Yang; Benpei Cheng; Senlin Ge, all of Peking University, Zhongguancun, Haidian District, Beijing 100871 (CN)

(73) Assignees: Yingchang Yang; Benpei Cheng; Senlin Ge, all of Beijing (CN)

( * ) Notice: Subject to any disclaimer, the term of this patent is extended or adjusted under 35 U.S.C. 154(b) by 0 days.

(21) Appl. No.: 09/593,595

(22) Filed: Jun. 14, 2000

(30) Foreign Application Priority Data

Sep. 14, 1999 (CN) ..... 99119076 A
Mar. 10, 2000 (CN) ..... 00102967 A

(51) Int. Cl.[7] ..... H01F 1/053; H01F 1/055; H01F 1/057; H01F 1/058; H01F 1/059

(52) U.S. Cl. ..... 148/302; 148/301

(58) Field of Search ..... 148/301, 302

(56) References Cited

U.S. PATENT DOCUMENTS

| | | | | |
|---|---|---|---|---|
| 5,186,766 A | | 2/1993 | Iriyama et al. | |
| 5,403,407 A | | 4/1995 | Hadjipanayis et al. | |
| 5,480,495 A | * | 1/1996 | Sakurada et al. | 148/301 |
| 5,567,891 A | * | 10/1996 | Bogatin et al. | 75/244 |
| 5,716,462 A | * | 2/1998 | Sakurada et al. | 148/302 |
| 5,800,728 A | * | 9/1998 | Iwata | 252/62.53 |

FOREIGN PATENT DOCUMENTS

| | | |
|---|---|---|
| CN | 90109166 | 11/1990 |
| EP | 369097 | 9/1988 |

OTHER PUBLICATIONS

Solid State Communications, vol. 78. No. 4, pp. 317–320, New Potential Hard Magnetic Material, Ying–chang Yang, Xiao–dong Zhang, Lin–shu Kong and Qi Pan 1991.

Solid Sstate Communications, vol. 78, No. 4, pp. 313–316, Neutron Diffraction Study of the Nitride YTiFe11Nx, Ying–chang Yang, Xiao–dong Zhang, Lin–shu Kong and Qi Pan 1991.

Appl. Phys Lett. 59 (18), Magnetocystalline anisotropies of RTiFe11Nx compounds, Ying–chang Yang, Xiao–dong Zhang, Lin–shu Kong and Qi Pan 1991.

* cited by examiner

*Primary Examiner*—John Sheehan
(74) *Attorney, Agent, or Firm*—Knobbe, Martens, Olson & Bear LLP

(57) ABSTRACT

There is provided a multielement rare earth-iron interstitial permanent magnetic material having the formula of $(R_{1-\alpha}R''_{\alpha})_x(Mo_{1-\beta}M_{\beta})_y\ Fe_{100-x-y-z}l_z$, wherein, R is a light rare earth element; R' is a heavy rare earth element; α is from 0.01 to 0.14; x is an atomic percent from 4 to 15; M is an element of IIIA, IVA, IVB, VB, VIB and VIIB families in the periodic table; β is from 0.01 to 0.98; y is an atomic percent from 3 to 20; l is an element occupying the interstitial site of the crystal selected from the first and the second periodic groups. There is also provided a process for producing high performance anisotropic magnetic powder and magnet by using the above-mentioned material.

4 Claims, 5 Drawing Sheets

MULTIELEMENT INTERSTITIAL HARD MAGNETIC MATERIAL AND PROCESS FOR PRODUCING MAGNETIC POWDER AND MAGNET USING THE SAME

The present invention relates to a multielement rare earth-iron interstitial hard magnetic material having a $ThMn_{12}$ type crystal structure. The present invention further relates to processes for producing isotropic and anisotropic magnetic powder, and for producing isotropic and anisotropic magnet.

Currently, the rare earth-iron based material used for producing hard magnet is $Nd_2Fe_{14}B$, in which the process used for producing $Nd_2Fe_{14}B$ type bonded magnet is melt spinning or HDDR technique. However, the magnetic powder obtained by using these processes is generally isotropic, with the maximum energy product of 60–110 KJ/m$^3$(8–13 MGOe). It is an anisotropic magnetic powder having a high magnetic energy product that is sought to be developed. The $Nd_2Fe_{14}B$ type magnet has a low Curie temperature, and is insufficient in anti-oxidation capacity. Furthermore, since spin reorientation occurs at the temperature around 130K, and easy magnetization direction deviates from C axis, the permanent magnetic properties vanish at low temperatures. Iriyama Kyohiko et al. and J. M. D. Coey et al. teach a $R_2Fe_{17}N_x$ based rare earth-iron-nitrogen permanent magnetic material (Iriyama Kyohiko et al., JP (31) 285741, 88; Iriyama Kyohiko et al., CN 89101552). For $R_2Fe_{17}N_x$, easy magnetization axis appears only when R is Sm. Consequently, in the preparation of high performance magnet, the rare earth utilized is mainly Sm that is more costly than Nd or Pr.

In 1990, Yingchang Yang et al. discovered the interstitial atomic effect of nitrogen in R $(Fe_{1-\alpha}M_\alpha)_{12}$ type intermetallic compound, wherein R is a rare earth element, M is Ti, V, Mo, Nb, Ga, W, Si, Al, or Mn, $\alpha$ a is from 0.08 to 0.27. The method comprises smelting a master alloy with the above composition, heat treating under nitrogen atmosphere at 350° C. to 600° C., to form a $R(Fe_{1-\alpha}M_\alpha)_{12}N_x$ interstitial type nitride, such as $NdTiFe_{11}N_x$. The result of the neutron diffraction study shows that nitrogen atoms have entered the 2b interstitial sites of $ThMn_{12}$ type crystal structure. Interstitial atoms enhance Fe-Fe exchange, thereby raise the Curie temperature by 200° C., modify 3d electron band structure of Fe, thus the magnetic moment of Fe is increased by 10–20%. Most importantly, interstitial atoms adjust the crystal field interactions of rare earth sites in crystals. Upon accomplishment of the nitrogenation, easy magnetization axis appear in the 1:12 type nitride of Pr, Nd, Tb, Dy, and Ho, which have very strong magneto-crystalline anisotropy fields. Therefore, $R(Fe_{1-\alpha}M_\alpha)_{12}N_x$, particularly $Nd(Fe_{1-\alpha}M_\alpha)N_x$, has intrinsic magnetic properties comparable to that of $Nd_2Fe_{14}B$, which can be used, besides $Nd_2Fe_{14}B$, as a rare earth permanent-magnetic material based on Nd instead of Sm. (see, for example, CN ZL90109166.9; Yingchang Yang et al., New Potential Hard Materials —Nd (Fe,Ti) $_{12}N_x$, *Solid State Communications*, 78(1991)317; Neutron Diffraction Study of the Nitrides $YTiFe_{11}N_x$, *Solid State Communications*, 78(1991)313; and Yingchang Yang et al., Magnetocrystalline Anisotropy of $YTiFe_{11}N_x$, *Applied Physics Letters*, 58(1991)2042. Since the publication of these results obtained by Yingchang Yang, there has been disclosed some other patent applications in this field, for example, U.S. Pat. No. 5,403,407 of G. C. Hadjipanayis et al. in 1992. In Hadjipanayis's patent, an alloy with a composition of $R_xFe_{y-w}CO_wM_zL_\alpha$ is employed, wherein R is a rare earth, M is Cr, Mo, Ti, or V, L is C or N, x is an atomic percent from 5 to 20, y is an atomic percent from 65 to 85, w is an atomic percent of about 20, z is an atomic percent from 6 to 20, and $\alpha$ is an atomic percent from 4 to 15. In this alloy, it is necessary to add 10–20 atomic percent of cobalt. After smelting of alloy, amorphous non-crystal magnetic material is formed by utilizing a high energy ball-mill mechanical alloying method, and a magnetic powder having a coercivity of 160–640 KA/m (2–8 kOe) is obtained by controlling the crystallization temperature. However, the magnetic powder thus obtained is isotropic, with very low remanence (Br), which is 0.3–0.4 T (3–4 KG), and very low maximum magnetic energy product ($(BH)_{max}$), which is 8–16 KJ/m$^3$(1–2 MGOe). This does not meet the requirement of practical application. As is well known, the parameters used to denote the performance of a permanent magnetic material include remanence Br, coercivity iHc and bHc, and maximum magnetic energy product $(BH)_{max}$. In these parameters, the maximum magnetic energy product is an overall indication of permanent magnetism, which represents the overall performance of magnet. In the above said patents, only the intrinsic magnetism of the material, such as saturation magnetization intensity (Ms), Curie temperature (Tc) and anisotropy field of magnetic moment (Ha) are dealt with, while the fundamental performance of permanent magnet are not. In other words, there is not disclosed a method to achieve higher remanence (Br) and higher maximum magnetic energy product ($(BH)_{max}$). Each of remanence (Br), coercivity (iHc and bHc) and maximum magnetic energy product ($(BH)_{max}$), which represents the performance of permanent magnetic materials, is structure sensitive. Theoretically, these parameters depend on the structure of magnetic domain and the process of demagnetization. Technically, these parameters depend on the microstructure of the material and the process of its production. This is a very special and very complicated problem that needs to be solved. It is just for this reason that such a category of materials has not been put into practical use since the discovery of the interstitial atomic effect in 1:12 type alloy by Yingchang Yang et al. a decade ago.

It is an object of this invention to provide a multielement rare earth-iron interstitial type permanent magnetic material having a ThMn12 crystal structure. The permanent magnetic material of the present invention has high remanence, high coercivity and high magnetic energy product. There is also provided a process for producing the permanent magnetic material of the present invention.

To this object, the composition of the 1:12 type nitride master alloy is modified based on the result obtained in the study of the magnetic domain structure and the magnetization reversal mechanism of 1:12 type nitride. It is expanded to a multielement alloy, which is featured in that an easily pulverizable alloy with better single-phase property can be produced. This is fundamental for producing high performance magnets. On the other hand, by using the process of the present invention, the activity of alloy is enhanced, the temperature of gas-solid phase reaction is lowered, and complete nitrogenation is ensured. Thereby the magnetism of the material is greatly enhanced, the content of rare earth metal is lowered, and the need to dope with expensive metals such as cobalt is eliminated. By using the process of the present invention, an anisotropic magnetic powder and a magnet having high remanence, high coercivity, and high magnetic energy product can be produced.

Specifically, there is provided a multielement rare earth-iron interstitial permanent magnetic material represent by the following formula:

$$(R_{1-\alpha}R'_\alpha)_x(Mo_{1-\beta}M_\beta)_yFe_{100-x-y-z}I_z$$

wherein, R is a light rare earth element selected from the group consisting of Pr, Nd, Pr—Nd concentrated material and mixtures of Pr and Nd of any composition; R' is a heavy rare earth element selected from the group consisting of Gd, Tb, Dy, Ho, Er, Y and a mixture of thereof; α is from 0.01 to 0.14; x is an atomic percent from 4 to 15; M is an element of IIIA, IVA, IVB, VB, VIB and VIIB families in the periodic table selected from the group consisting of B, Ti, V, Cr, Mn, W, Si, Al, Ga, Nb, Ta, Sr, Zr, and mixtures of thereof; β is from 0.01 to 0.98; y is an atomic percent from 3 to 20; l is an element occupying the above mentioned interstitial site of the crystal selected from the first and the second periodic groups consisting of H, C, N, F, and mixtures thereof; z is an atomic percent from 5 to 20.

Examples of the permanent magnetic material represented by formula $(R_{1-\alpha}R'_{\alpha})_x(Mo_{1-\beta}M_{\beta})_yFe_{100-x-y-z}l_z$ include:

$(Pr_{0.9}Tb_{0.1})_{7.0}(Mo_{0.9}Nb_{0.1})_{7.4}Fe_{77.1}N_{8.5}$;

$(Pr_{0.9}Tb_{0.1})_{6.8}(Mo_{0.8}Nb_{0.2})_{10.0}Fe_{72.9}N_{10.3}$;

$(Pro_{0.9}Tb_{0.1})_{6.8}(Mo_{0.7}Nb_{0.3})_{10.0}Fe_{72.9}N_{10.3}$;

$(Pr_{0.92}Tb_{0.08})_{6.6}(MO_{0.1}Ti_{0.9})_{6.5}Fe_{73.4}N_{13.5}$;

$(Pr_{0.92}Tb_{0.08})_{6.6}(Mo_{0.2}Ti_{0.8})_{6.5}Fe_{73.4}N_{13.5}$;

$(Pr_{0.92}Tb_{0.08})_{6.6}(Mo_{0.3}Ti_{0.7})6.5Fe_{73.4}N_{3.5}$;

$(Pr_{0.95}Tb_{0.05})_{6.5}(Mo_{0.1}V_{0.9})Fe_{68.3}N_{16.2}$;

$(Pr_{0.95}Tb_{0.05})_{6.5}(Mo_{0.2}V_{0.8})_{9.0}Fe_{68.3}N_{16.2}$;

$(Pr_{0.95}Tb_{0.05})_{6.5}(Mo_{0.3}V_{0.7})_{9.0}Fe_{68.3}N_{16.2}$, wherein, Pr may be substituted with Nd, a Pr—Nd concentrated material, or a mixture of Pr and Nd; Tb may be substituted with Gd, Dy, Ho, Er, Y, or a mixture thereof; Nb, Ti, V and the like may be substituted with B, Ti, V, Cr, Sr, Mn, W, Si, Al, Nb, Ta, Zr or a mixture of one or more of them.

The light rare earth used in the present invention is preferably Pr, Nd, a mixture of Pr and Nd, or a Pr—Nd concentrated material. In the 1:12 type nitrides, Pr and Nd have strong easy axial magnetocrystalline anisotropy, which generate high coercivity. Furthermore, the light rare earth element, Pr and Nd, couple ferromagnetically with Fe, thereby having high saturation magnetization intensity, which is fundamental for producing materials having high remanence and high magnetic energy product. It was found that, for the purpose of producing high performance magnet, it is essential to include a suitable amount of at least a heavy rare earth element such as Gd, Tb, Dy, Ho, Er or the like in the alloy. Only in this way, high performance and high temperature stability of the magnet thus produced can be ensured. In addition, the atomic percent x is preferably from 6 to 10.

As is well known, in order to prepare 1:12 phase based on rare earth-iron, it is necessary to add a suitable amount of a third element M. However, it was discovered by the inventors of the present invention that it is impossible to obtain a high performance magnet by utilizing a $R(Fe, M)_{12}$ type master alloy comprising only a single third element. In a study aimed to enhance the gas-solid phase reaction, to significantly improve the magnetism of the material, and to facilitate the grinding of the crystal particles, it was further discovered that the third element M is required to be combined with Mo, wherein, M is B, Nb, Ti, V, Cr, Mn, Al, Ga, Si, Sr, Ta, W, or Zr or a mixture of two or more of them. In other words, it is indispensable to include Mo and another third element M in the material so as to produce a high performance magnet of 1:12 type nitride, wherein, M is as defined above. In case that the third element is mainly Mo, β is preferably 0.01–0.40, and in case that the third element is mainly M, β is preferably 0.80–0.98. The atomic percent y is preferably 6–12. The results of comparative experiments are shown in Examples 1–12.

The process for producing the magnet of the present invention includes the following steps:

(1) When l is H, N or F, a master alloy is prepared by using R, R', Fe, Mo, and M according to the formula $(R_{1-\alpha}R'_{\alpha})_x(Mo_{1-\beta}M_{\beta})_yFe_{100-x-y-z}$; when l is C, a master alloy is prepared by using C and the metals of R, R', Fe, Mo, and M according to the formula $(R_{1\alpha}R'_{\alpha})_x(Mo_{1-\beta}M_{\beta})_yFe_{100-x-y-z}l_z$. The alloy thus produced is featured in having a $ThMn_{12}$ tetragonal crystal structure, thus is referred to as 1:12 type compound. The multielement alloy of the present invention is apt to form uniform 1:12 phase. FIG. 1 and FIG. 2 show the X-ray diffraction pattern of thus obtained $Nd_{7.2}Dy_{0.5}V_{11.0}Mo_{0.5}Fe_{0.8}$ and $Pr_{6.6}Dy_{0.4}Mo_{9.50}Ti_{0.5}Fe_{76}C_7$, respectively. As can be seen from the figures, they are single 1:12 phase. Further, as can be seen from the thermal magnetic curve of FIG. 3, no α–Fe is included.

(2) The master alloy obtained in step (1) is treated in the hydrogen atmosphere at 200–400° C. for 2–4 hours, and a powder with the particle size in microns is formed. It was found that hydrogen holds 2b interstitial sites in the alloy, which is similar to nitrogen. Thus, hydrogen has an interstitial atomic effect for improving magnetism similar to that of nitrogen, as is shown in Example 14. Hydrogen treatment is a pretreatment for nitrogenation. As the result of hydrogen treatment, the activity of the material is enhanced, thereby, the particle size of the nitrided powder is enlarged, and the temperature and the time of nitrogenation are reduced. This is one of the measures to avoid oxidation and to ensure complete nitrogenation of the materials, thereby enhancing permanent magnetic properties. Especially, when y is selected from the lower part of the above said range, the performance of the hard magnetic properties varies significantly depending upon whether or not hydrogenation treatment is carried out, as is shown in Example 15.

(3) Gas-solid phase reaction of the above treated powder is allowed to proceed in a corresponding atmosphere l at given temperatures. For example, when l is N, heat treatment is carried out in nitrogen atmosphere of 1–10 atmospheric pressure at 300–650° C. for 1–20 hours. As the result of the gas-solid phase reaction, a nitride having the composition of $(R_{1-\alpha}R'_{\alpha})_x(Mo_{1-\beta}M_{\beta})_yFe_{100-x-y-z}N_z$ is formed. The nitride thus obtained features in a $ThMn_{12}$tetragonal crystal structure, accordingly is referred to as 1:12 type nitride. The multielement alloy and the process provided by the present invention facilitate the proceeding of the gas-solid reaction. Complete nitrogenation can be achieved under single-phase conditions, namely under the conditions of absence of oxide and α–Fe. Nitrogen content of the magnet is up to 5–20 at %. Compared with 1:12 type master alloy, the Curie temperature and the saturation magnetization of 1:12 master alloy are significantly increased, and the magnetocrystalline anisotropy of rare earth ions is changed after nitrogen absorption, particularly, the easy magnetization direction is c axis from OK to Curie temperature for 1:12 nitride of Pr, Nd, Tb, Dy, and Ho. When I is F, heat treatment is carried out at a temperature of 200–500° C. in a fluorine atmosphere of 1–4 atmospheric pressure for 1–2 hours, then a corresponding fluoride of the invention is obtained. The result of the band structure analysis shows that, the fluorine has an optimum interstitial atomic effect. In fluorides, the increment of magnetic moment of iron atoms is greater than that in nitrides or carbides.

(4) The 1:12 type material processed through above step 2) and/or step 3) is pulverized into a powder with the particle size of 1–10 $\mu$m by using a jet mill or ball mill. An anisotropic high performance magnetic powder is formed, which is featured in that the maximum magnetic energy product is above 160 KJ/m$^3$ (20MGOe).

(5) A protective coat can be formed on the surface of magnetic powder by using 1:12 type magnetic powder through complex reaction, such as, the magnetic powder obtained from step (3) is milled in the solution of citric acid, ammonium acetate or potassium thiocyanate. Oxidation resistance is enhanced through the metal-complex reaction.

(6) A binder is added into the coated magnetism powder, then oriented through press molding in a magnetic field. A high performance anisotropic bonded magnet is obtained upon solidification.

In another embodiment of the present invention, the 1–10 $\mu$m magnetic powders are directly mixed with a polymer or rubber. Then a bonded magnet is formed through injection molding in a magnetic field. Alternatively, it is mixed with a low-melting-point metal, such as Zn, Sn and the like, or an alloy thereof, then pulverized into a powder with the particle size of 1–10 $\mu$m, oriented in a magnetic field, press molded, and an anisotropic sintered magnet is obtained upon sintering.

In the process of the present invention, when l is C, step (2) and (3) are not needed. The process of the invention is featured in that C enters an interstitial site through direct melting, instead of through gas-solid reaction. The magnetic powders of carbide according to the present invention have the advantages of good temperature stability. When I is H, the process can be carried out to step (4) directly without passing step (3).

In addition, a high performance magnet can be produced through other methods by utilizing the multielement alloy of the present invention. Examples of these methods include mechanical alloying, which comprises the steps of: when I is N, (1) the metallic powders of R, R', Fe, Mo, M and the like are subjected to high energy milling in argon atmosphere for 2–4 hours with the composition of $(R_{1-\alpha}R'_{\alpha})_x(Mo_{1-\beta}M_{\beta})_yFe_{100-x-y}$ to obtain the resulted amorphous metal powders; (2) carrying out crystallization treatment in argon atmosphere at 700–950° C., and keeping at this temperature for 0.5–2 hours; (3) carrying out gas-solid reaction in the atmosphere of interstitial atom, for example, carrying out nitrogen treatment at 400–600° C. for 2–4 hours, then a high performance magnetic powder is obtained. In this method, when l is C, step (1) is performed by preparing a corresponding powder according to formula $(R_{1-\alpha}R'_{\alpha})_x(Mo_{1-\beta}M_{\beta})_yFe_{100-x-y}C_z$, conducting high energy milling in argon atmosphere for 2–4 hours, thus, a amorphous powder is formed; step (2) is performed as mentioned above, and step (3) is omitted; finally, a high performance magnetic powder is formed. These method also include melt spinning method, which comprise the steps of: when I is N, (1) melting an alloy with the composition of $(R_{1-\alpha}R'_{\alpha})_x(Mo_{1-\beta}M_{\beta})_yFe_{100-x-y}$; (2) cooling in vacuum at the rate of 30–50 m/second; (3) carrying out crystallization treatment in argon atmosphere at 700–950° C., and keeping at this temperature for 0.5–2 hours; (4) carrying out gas-solid reaction in the atmosphere of interstitial atom, for example, carrying out nitrogen treatment at 400–600° C. for 2–4 hours, then a high performance magnetic powder is obtained. In this method, when l is C, step (1) is performed by melting an alloy according to formula $(R_{1-\alpha}R'_{\alpha})_x(Mo_{1-\beta}M_{\beta})_yFe_{100-x-y}C_z$; steps (2) and (3) are performed as mentioned above, and step (4) is omitted; finally, a high performance magnetic powder is formed.

In the process of the present invention, after hydrogenation treatment, evacuated dehydrogenation treatment at 500–600° C. may be performed.

By using the magnetic powder of the present invention, compressed, injected and extruded bonded magnet can be produced by adding a thermosetting binder, or a calendered bonded magnet can be produced by adding a thermoplastic binder. In particular, compressed and injected anisotropic bonded magnets can be produced by taking form in a magnetic field. Further, mixing the magnetic powder of the present invention and a ferrite magnetic powder can produce a unique composite magnet. Since the particle size of them are comparable, a uniform calendered, injected or compressed bonded magnet can be produced. As the magnetic powder of the present invention has high remanence while ferrite has a positive temperature coefficient of coercivity, thus it is available to produce composite magnets with high magnetic performance and good thermal stability at a low cost.

The binders used in the present invention includes polyolefin polymers, such as polyethylene, polypropylene, polyvinyl chloride, nylon and the like; polyester polymers, such as polyether, polyurethane, polycarbonate and the like; aromatic polyester resins, such as epoxy resin, phenolic resin, pollopas and the like; natural or synthetic rubbers, such as natural rubber, butadiene rubber, duprene rubber, silicon rubber and the like.

To assist in understanding the present invention, the following Examples are included which describes the results of a series of experiments. The experiments relating to this invention should not, of course, be construed as specifically limiting the invention.

EXAMPLE 1

Figure 1:
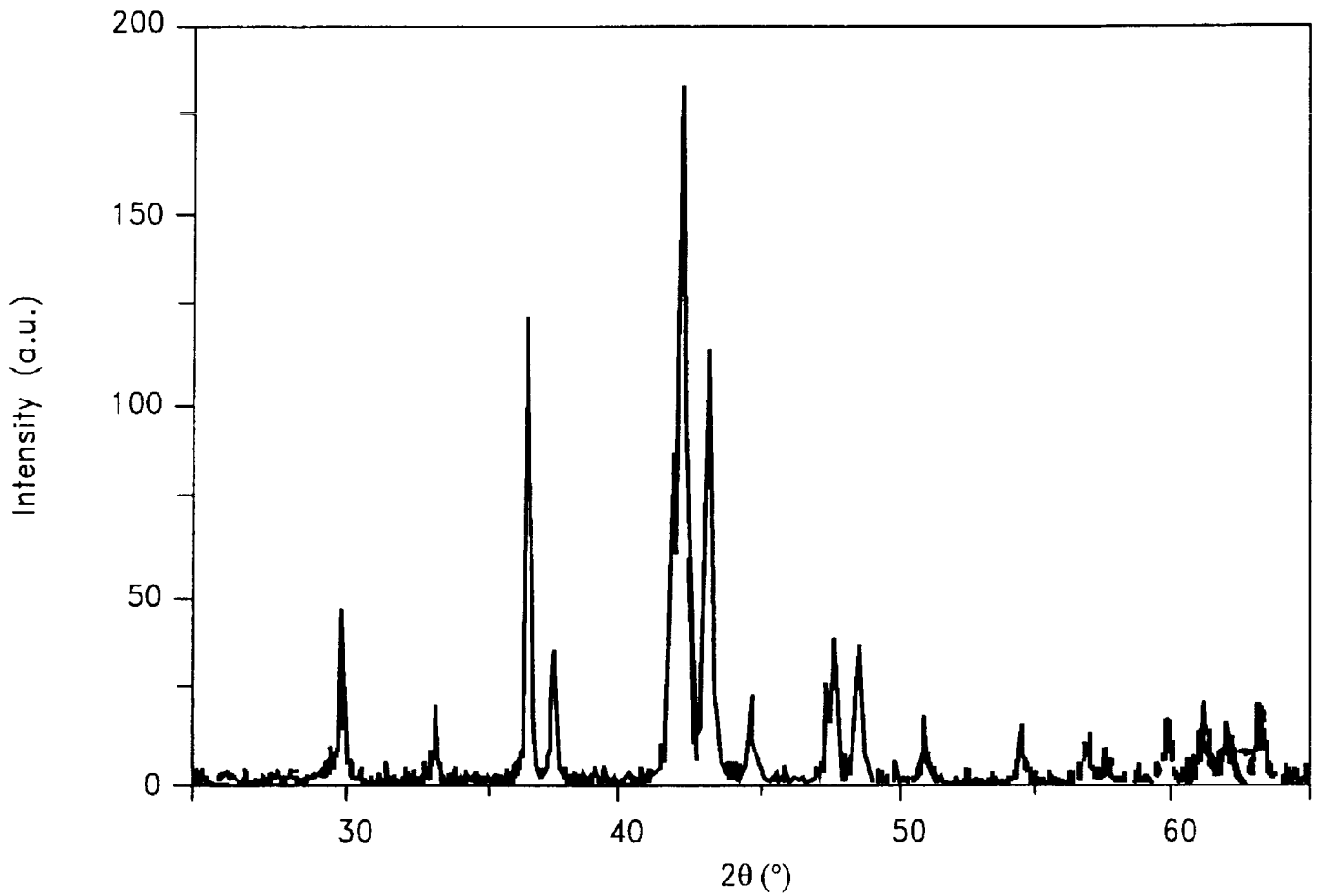
FIG. 1 shows the X-ray diffraction pattern of $Nd_{7.2}Dy_{0.5}V_{11.0}Mo_{0.5}Fe_{80.8}$.
Figure 2:
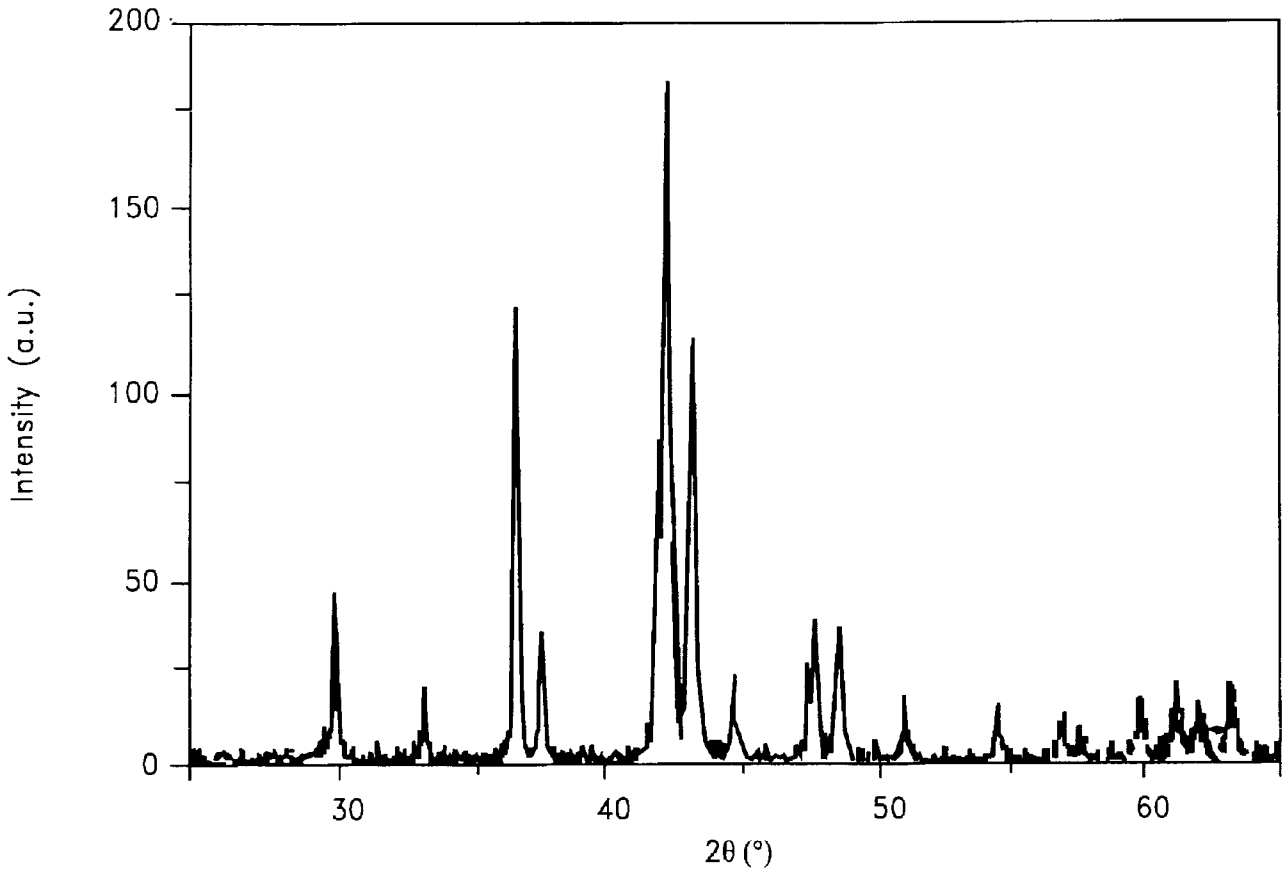
FIG. 2 shows the X-ray diffraction pattern of $Pr_{6.6}Dy_{0.4}Mo_{9.50}Ti_{0.5}Fe_{76}C_7$.
Figure 3:
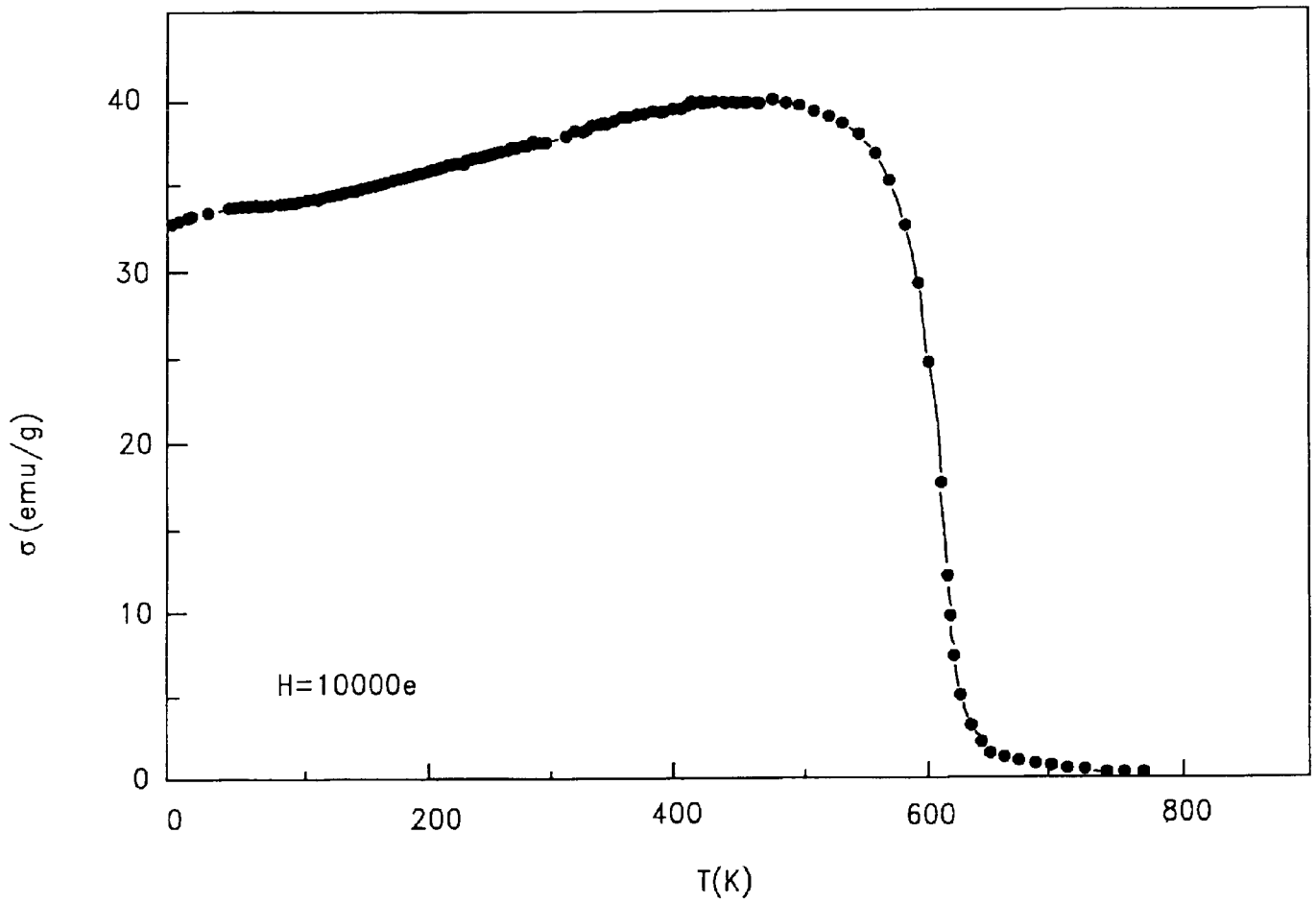
FIG. 3 shows the magnetothermal curve of $Pr_{7.2}Dy_{0.5}V_{11.0}Mo_{0.5}Fe_{80.8}$.
Figure 4:
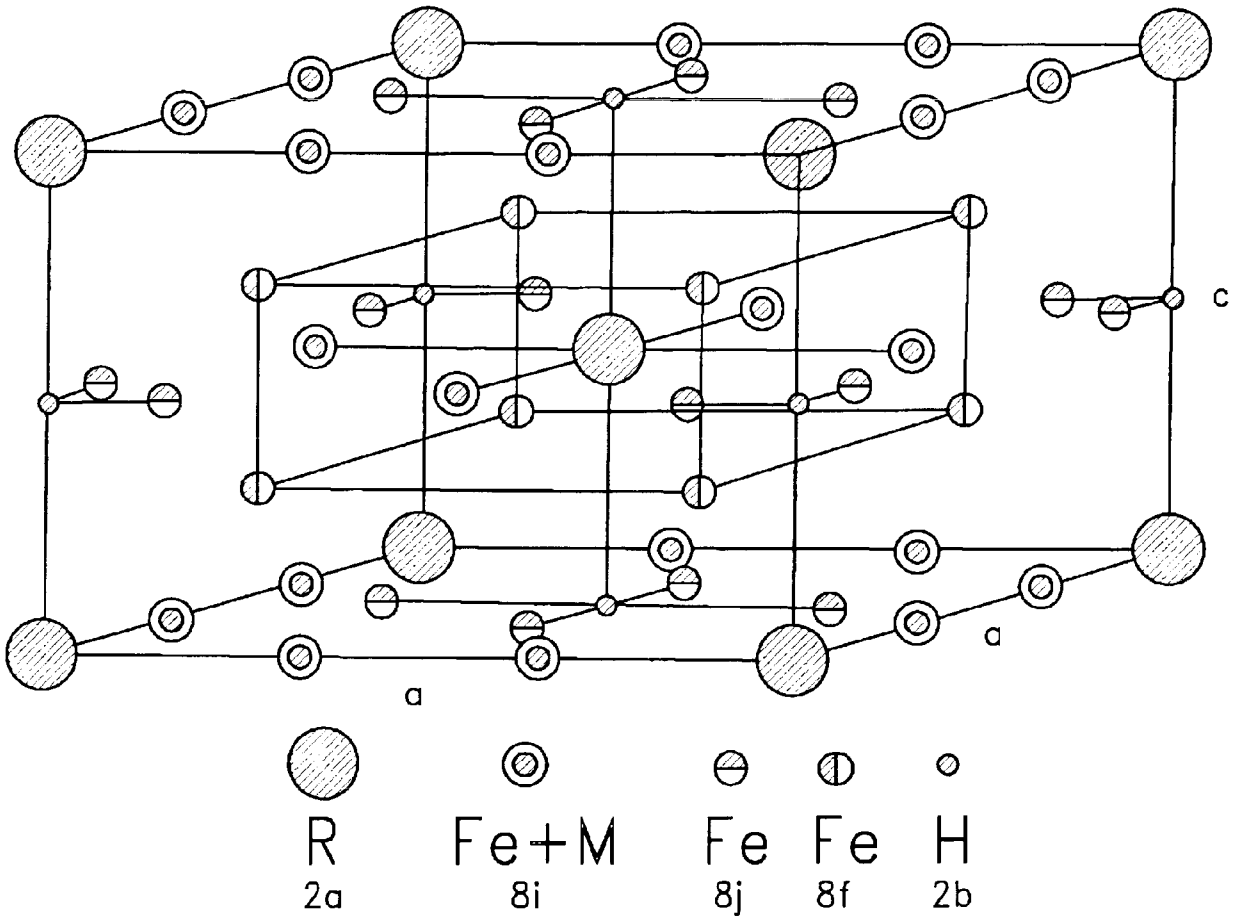
FIG. 4 shows the crystal structure of $ThMn_{12}$ type hydrogenide.

An alloy was melted in a vacuum induction furnace with the composition of 7.2 at % Nd, 0.5 at %Dy, 80.8 at % Fe, 11 at % Mo and 0.5 at % B, followed by a treatment in hydrogen at 250° C. for 2 hours. Then, thermal treatment at 550° C. in nitrogen atmosphere of 1 atmospheric pressure was carried out, and it was kept at this temperature for 2 hours. A 1:12 type nitride is obtained through gas-solid phase reaction, with the composition of 6.3 at % Nd, 0.4 at % Dy, 75.5 at % Fe, 10.2 at % Mo, 0.5 at % B and 7.at % N. The nitride is pulverized by using a jet mill or ball mill into a powder having the particle size of 2–5 $\mu$m. An anisotropic magnetic powder was obtained. After oriented in a magnetic field, a magnetic powder having the magnetic performance as shown in Table 1 was obtained:

TABLE 1

| Temperature | $B_r$ (T) | $_iH_c$ (KA · m$^{-1}$) | $_bH_c$ (KA · m$^{-1}$) | $(BH)_{max}$ (KJ · m$^{-3}$) | $T_c$ (K) |
|---|---|---|---|---|---|
| Room temperature | 1.08 | 640 | 512 | 184 | 740 |
| 1.5K | 1.25 | 3072 | 880 | 308 | |

The process in this Example was carried out, except that the temperature and the time of nitrogenation varied. Nitride magnetic powders with various nitrogen contents were obtained, which have permanent magnetic performance as shown in Table 2.

TABLE 2

The permanent magnetic performance of $Nd_{7.7}Dy_{0.5}Fe_{80.8}Mo_{11}B_{0.5}N_z$

| Temperature and time of nitrogenation | Nitrogen content Z | Br (T) | $_iH_c$ (KA · m$^{-1}$) | $(BH)_{max}$ (KJ · m$^{-3}$) |
|---|---|---|---|---|
| Not subject to nitrogenation | 0.0 | 0.3 | 0.8 | 0.2 |
| 400° C., 3 hrs | 3.0 | 0.6 | 40 | 4.0 |
| 500° C., 1 hrs | 5.0 | 0.9 | 240 | 64 |
| 550° C., 2 hrs | 7.1 | 1.08 | 640 | 184 |
| 550° C., 4 hrs | 10.3 | 1.10 | 720 | 188 |
| 550° C., 8 hrs | 14.2 | 1.15 | 680 | 192 |
| 650° C., 4 hrs | 20.0 | 1.00 | 160 | 32 |

EXAMPLE 2

The process of Example 1 was carried out, except that the master alloy was melted with the composition of 7.3 at % Pr, 0.4 at % Dy, 80.8 at % Fe, 11 at % Mo, and 0.5 at % Nb. The 1:12 nitride magnetic powder thus obtained having the performance as shown in Table 3.

TABLE 3

| Temperature | $B_r$ (T) | $_iH_c$ (KA · m$^{-1}$) | $_bH_c$ (KA · m$^{-1}$) | $(BH)_{max}$ (KJ · m$^{-3}$) | $T_c$ (K) |
|---|---|---|---|---|---|
| Room temperature | 1.05 | 520 | 480 | 162 | 640 |
| 1.5K | 1.18 | 2448 | 880 | 254 | |

The process of this Example was carried out, except that the master alloy was melted with the composition of 7.3 at % Pr, 0.4 at % Dy, 80.1 at % Fe, 11.7 at % $Mo_{1-\beta}Nb_\beta$), nitride magnetic powders of $(Pr_{0.95}Dy_{0.05})_{6.8}(Mo_{1-\beta}Nb_\beta)_{10.0}Fe_{72.9}N_{10.3}$with various D values obtained. The permanent magnetic performance at room temperature are shown in Table 4 below.

TABLE 4

Permanent magnetic performance of $(Pr_{0.95}Dy_{0.05})_{6.8}(Mo_{1-\beta}Nb_\beta)_{10.0}Fe_{72.9}N_{10.3}$

| β | Br (T) | $_iH_c$ (KA · m$^{-1}$) | $(BH)_{max}$ (KJ · m$^{-3}$) |
|---|---|---|---|
| 0.00 | 0.4 | 160 | 12 |
| 0.01 | 0.8 | 240 | 63 |
| 0.05 | 1.00 | 520 | 160 |
| 0.10 | 1.05 | 640 | 196 |
| 0.15 | 1.15 | 660 | 208 |
| 0.20 | 1.00 | 480 | 148 |

TABLE 4-continued

Permanent magnetic performance of $(Pr_{0.95}Dy_{0.05})_{6.8}(Mo_{1-\beta}Nb_\beta)_{10.0}Fe_{72.9}N_{10.3}$

| β | Br (T) | $_iH_c$ (KA · m$^{-1}$) | $(BH)_{max}$ (KJ · m$^{-3}$) |
|---|---|---|---|
| 0.30 | 0.90 | 320 | 80 |
| 0.40 | 0.70 | 296 | 40 |

EXAMPLE 3

The process of Example 2 was carried out, except that the master alloy was melted with the composition of 7.7 at % $(Pr_{1-\alpha}Dy_\alpha)$, 80.1 at % Fe, 10.6 at % Mo, and 1.1 at % Nb, nitride magnetic powders of $(Pr_{1-\alpha}Dy_{60})_{6.8}(Mo_{0.9}Nb_{0.1})_{10}Fe_{72.9}N_{10.3}$ with various a values were obtained. The permanent magnetic performance at room temperature are shown in Table below.

TABLE 5

Permanent magnetic performance of $(Pr_{1-\alpha}Dy_\alpha)_{6.8}(Mo_{0.9}Nb_{0.1})_{10}Fe_{72.9}N_{10.3}$

| α | Br (T) | $_iH_c$ (KA · m$^{-1}$) | $(BH)_{max}$ (KJ · m$^{-3}$) |
|---|---|---|---|
| 0.00 | 0.90 | 360 | 96 |
| 0.01 | 0.95 | 400 | 104 |

TABLE 5-continued

Permanent magnetic performance of $(Pr_{1-\alpha}Dy_\alpha)_{6.8}(Mo_{0.9}Nb_{0.1})_{10}Fe_{72.9}N_{10.3}$

| α | Br (T) | $_iH_c$ (KA · m$^{-1}$) | $(BH)_{max}$ (KJ · m$^{-3}$) |
|---|---|---|---|
| 0.05 | 1.00 | 520 | 160 |
| 0.10 | 1.15 | 660 | 208 |
| 0.14 | 0.90 | 480 | 112 |
| 0.20 | 0.80 | 320 | 80 |
| 1.00 | 0.20 | 120 | 8 |

EXAMPLE 4

The process of Example 1 was carried out, except that the master alloy was melted with the composition of 7.2 at % Nd, 0.5 at % Tb, 80.8 at % Fe, 11.0 at % Mo, and 0.5 at % Ti. Then hydrogen treatment was carried out at 200° C. for 4 hours. Thereafter, thermal treatment at 500° C. in nitrogen atmosphere of 5 atmospheric pressure was carried out, and it was kept at this temperature for 10 hours. A 1:12 nitride magnetic powder with the composition of 6.3 at % Nd, 0.4 at % Tb, 69.9 at % Fe, 9.5 at % Mo, 0.4 at % Ti and 13.5 at % N was obtained. The performance was shown in Table 6.

TABLE 6

| Temperature | $B_r$ (T) | $_iH_c$ (KA · m$^{-1}$) | $_bH_c$ (KA · m$^{-1}$) | $(BH)_{max}$ (KJ · m$^{-3}$) | $T_c$ (K) |
|---|---|---|---|---|---|
| Room temperature | 1.12 | 520 | 480 | 188 | 710 |
| 1.5K | 1.25 | 1800 | 880 | 280 | |

The process of this Example was carried out, except that the alloy was melted with the composition of 7.2 at % Nd, 0.5 at % Tb, 80.8 at % Fe, 11.5 at % $(Mo_{1-\beta}Ti_\beta)$, magnetic powders of $Nd_{6.3}Tb_{0.4}Fe_{69.9}(Mo_{1-\beta}Ti_\beta)_{9.5}N_{13.5}$ were obtained. The permanent magnetic performance at room temperature are shown in Table 7 below.

TABLE 7

Permanent magnetic performance of $Nd_{6.3}Tb_{0.4}Fe_{69.9}(Mo_{1-\beta}Ti_\beta)_{9.5}N_{13.5}$.

| β | Br (T) | $_iH_c$ (KA · m$^{-1}$) | $(BH)_{max}$ (KJ · m$^{-3}$) |
|---|---|---|---|
| 0.00 | 0.4 | 48 | 5 |
| 0.04 | 1.05 | 400 | 150 |
| 0.10 | 1.10 | 508 | 180 |
| 0.20 | 1.15 | 620 | 196 |
| 0.30 | 1.20 | 600 | 204 |
| 0.40 | 1.00 | 400 | 120 |

EXAMPLE 5

The process of Example 4 was carried out, except that the alloy was melted with the composition of 7.7 at % $(Nd_{1-\alpha}Tb_\alpha)$, 9.2 at % Mo, 2.3 at % Ti, and 80.8 at % Fe, magnetic powders of $(Nd_{1-\alpha}Tb_\alpha)_{6.7}Fe_{69.9}Mo_{7.6}Ti_{1.9}N_{13.5}$ were obtained. The permanent magnetic performance at room temperature are shown in Table 8 below.

TABLE 8

Permanent magnetic performance of $(Nd_{1-\alpha}Tb_\alpha)_{6.7}Fe_{69.9}Mo_{7.6}Ti_{1.9}N_{13.5}$

| α | Br (T) | $_iH_c$ (KA · m$^{-1}$) | $(BH)_{max}$ (KJ · m$^{-3}$) |
|---|---|---|---|
| 0.00 | 0.8 | 240 | 48 |
| 0.01 | 0.9 | 350 | 64 |
| 0.05 | 1.05 | 480 | 160 |
| 0.10 | 1.10 | 550 | 178 |
| 0.14 | 0.90 | 400 | 96 |
| 0.20 | 0.80 | 300 | 56 |

EXAMPLE 6

An alloy was melted with the composition of 7.2 at % Nd, 0.7 at % Dy, 83.8 at % Fe, 8.3 at % $(Mo_{1-\beta}Ti_\beta)$, followed by treatment in hydrogen at 200 ° C. for 4 hours. Then, thermal treatment at 350° C. in nitrogen atmosphere of 10 atmospheric pressure was carried out, and it was kept at this temperature for 10 hours, then milled into powders in citric acid solution. Magnetic powders of $Nd_{6.0}Dy_{0.6}Fe_{73.1}(Mo_{1-\beta}Ti_\beta)_{6.8}N_{13.5}$ were obtained. The permanent magnetic performance at room temperature are shown in Table 9 below.

TABLE 9

Permanent magnetic performance of $Nd_{6.0}Dy_{0.6}Fe_{73.1}(Mo_{1-\beta}Ti_\beta)_{6.8}N_{13.5}$

| β | Br (T) | $_iH_c$ (KA · m$^{-1}$) | $(BH)_{max}$ (KJ · m$^{-3}$) |
|---|---|---|---|
| 1.00 | 0.6 | 6.4 | 3.2 |
| 0.98 | 0.8 | 88 | 16 |
| 0.95 | 1.0 | 280 | 80 |
| 0.90 | 1.1 | 480 | 180 |
| 0.85 | 0.9 | 320 | 104 |
| 0.70 | 0.8 | 320 | 76 |
| 0.60 | 0.8 | 160 | 48 |

EXAMPLE 7

The process of Example 1 was carried out in this example, except that Pr—Nd concentrated material was used as light rare earth metal, and the alloy was melted with the composition of 2 at % Pr, 6.5 at % Nd, 0.5 at % Dy, 79.5 at % Fe, 10.5 at % Mo and 1.0 at % V. A magnetic powder of $Pr_{1.9}Nd_{6.0}Dy_{0.5}Fe_{73}Mo_{9.7}V_{0.9}N_{8.0}$ with the following permanent magnetic performance were obtained.

TABLE 10

| Temperature | $B_r$ (T) | $_iH_c$ (KA · m$^{-1}$) | $_bH_c$ (KA · m$^{-1}$) | $(BH)_{max}$ (KJ · m$^{-3}$) | $T_c$ (K) |
|---|---|---|---|---|---|
| Room temperature | 1.05 | 464 | 400 | 160 | 720 |
| 1.5K | 1.23 | 1680 | 920 | 290 | |

The process of this Example was carried out, except that the alloy was melted with the composition of 2 at % Pr, 6.5 at % Nd, 0.5 at % Dy, 79.5 at % Fe, and 11.5% $(Mo_{1-\beta}V_\beta)$. Magnetic powders of $Pr_{1.9}Nd_{6.0}Dy_{0.5}Fe_{73}(Mo_{1-\beta}V_\beta)_{10.6}N_{8.0}$ were obtained. The permanent magnetic performance at room temperature are shown in Table 11 below.

TABLE 11

Permanent magnetic performance of $Pr_{1.9}Nd_{6.0}Dy_{0.5}Fe_{73}(Mo_{1-\beta}V_\beta)_{10.6}N_{8.0}$

| β | Br (T) | $_iH_c$ (KA · m$^{-1}$) | $(BH)_{max}$ (KJ · m$^{-3}$) |
|---|---|---|---|
| 0.00 | 0.50 | 160 | 12 |
| 0.05 | 1.05 | 400 | 160 |
| 0.10 | 1.05 | 560 | 176 |
| 0.15 | 1.08 | 580 | 178 |
| 0.20 | 1.20 | 600 | 186 |
| 0.30 | 1.05 | 560 | 178 |
| 0.40 | 1.00 | 342 | 128 |

EXAMPLE 8

An alloy was melted with the composition of $Nd_{8.0}Tb_{0.5}Fe_{79.0}(Mo_{1-\beta V\beta})_{11.5}$, followed by treatment in hydrogen at 250° C. for 2 hours. Then, thermal treatment at 400° C. in nitrogen atmosphere of 1 atmospheric pressure was carried out, and it was kept at this temperature for 4 hours. Magnetic powders of $Nd_{7.2}Tb_{0.5}Fe_{69.3}(Mo_{1-\beta}V_\beta)_{9.5}N_{14.0}$ were obtained. The permanent magnetic performance at room temperature are shown in Table 12 below.

TABLE 12

Permanent magnetic performance of $Nd_{7.2}Tb_{0.5}Fe_{69.3}(Mo_{1-\beta}V_\beta)_{9.5}N_{14.0}$

| β | Br (T) | $_iH_c$ (KA · m$^{-1}$) | $(BH)_{max}$ (KJ · m$^{-3}$) |
|---|---|---|---|
| 1.00 | 0.5 | 100 | 10 |
| 0.98 | 0.9 | 240 | 48 |
| 0.95 | 1.1 | 350 | 80 |
| 0.90 | 1.2 | 480 | 202 |
| 0.86 | 1.1 | 480 | 180 |
| 0.80 | 1.0 | 440 | 120 |
| 0.70 | 1.0 | 400 | 98 |
| 0.60 | 1.0 | 360 | 96 |

EXAMPLE 9

The process of Example 8 was carried out, except that the temperature and the time of nitrogenation varied. Nitride magnetic powders with various nitrogen contents were obtained, which have permanent magnetic performance as shown in Table 13.

TABLE 13

The permanent magnetic performance of $Nd_{8.0}Tb_{0.5}Fe_{79.0}Mo_{1.0}V_{10.5}N_z$

| Temperature and time of nitrogenation | Nitrogen content Z | Br (T) | $_iH_c$ (KA · m$^{-1}$) | $(BH)_{max}$ (KJ · m$^{-3}$) |
|---|---|---|---|---|
| Not subject to nitrogenation | 0.0 | 0.3 | 1 | 0.1 |
| 300° C., 2 hrs | 5.0 | 0.9 | 120 | 40 |
| 400° C., 1 hrs | 10.1 | 1.0 | 240 | 128 |
| 400° C., 5 hrs | 16.2 | 1.2 | 520 | 202 |
| 450° C., 5 hrs | 20.0 | 1.0 | 80 | 48 |

EXAMPLE 10

The process of Example 1 was carried out, except that the alloy was melted with the composition of 7.2 at % Nd, 0.5 at % Gd, 80.8 at % Fe, 11.5 at % $(Mo_{1-\beta}Ta_\beta)$, and the gas-solid phase reaction was carried out under nitrogen atmosphere of 8 atmospheric pressure. Magnetic powders of $Nd_{6.6}Gd_{0.5}Fe_{74.4}(Mo_{1-\beta}Ta_\beta)_{11.1}N_{7.7}$ were obtained. The permanent magnetic performance at room temperature are shown in Table 14 below.

TABLE 14

Permanent magnetic performance of $Nd_{6.6}Gd_{0.5}Fe_{74.4}(Mo_{1-\beta}Ta_\beta)_{11.1}N_{7.7}$

| β | Br (T) | $_iH_c$ (KA · m$^{-1}$) | $(BH)_{max}$ (KJ · m$^{-3}$) |
|---|---|---|---|
| 0.00 | 0.3 | 5 | 3 |
| 0.01 | 0.6 | 200 | 24 |
| 0.05 | 0.9 | 320 | 48 |
| 0.10 | 1.0 | 520 | 160 |
| 0.20 | 1.1 | 560 | 170 |
| 0.30 | 1.0 | 540 | 165 |
| 0.40 | 0.8 | 320 | 60 |

EXAMPLE 11

A master alloy with the composition of 5.0 at % C, 7.0 at % Nd, 20 0.4 at % Tb, 76.at % Fe, 11.0 at % Mo, and 0.5 at % Nb was melted, wherein, C has directly entered the interstitial site, thus gas-solid reaction is no longer needed. The product was pulverized through the process identical with that in Example 1. The 1:12 type magnetic powder thus obtained has the performance as shown in Table 15 below.

TABLE 15

| Temperature | $B_r$ (T) | $_iH_c$ (KA · m$^{-1}$) | $_bH_c$ (KA · m$^{-1}$) | $(BH)_{max}$ (KJ · m$^{-3}$) | $T_c$ (K) |
|---|---|---|---|---|---|
| Room temperature | 0.98 | 480 | 400 | 144 | 620 |
| 1.5K | 1.10 | 2400 | 880 | 204 | |

An alloy with the composition of $Nd_{0.9}Tb_{0.1}Fe_{10.5}Mo_{1.4}Si_{0.1}C_Z$ was melted, wherein, C has directly entered the interstitial site of the $ThMn_{12}$ type crystal, thus gas-solid reaction is no longer needed. The product was pulverized through jet mill or ball mill into a magnetic powder with the particle size of 2–5 μm. After oriented in a magnetic field, the powder exhibits the following performance.

TABLE 16

The permanent magnetic performance of $Nd_{0.9}Tb_{0.1}Fe_{10.5}Mo_{1.4}Si_{0.1}C_z$

| Carbon content Z | Br (T) | $_iH_c$ (KA · m$^{-1}$) | $(BH)_{max}$ (KJ · m$^{-3}$) |
|---|---|---|---|
| 0.0 | 0.2 | 0.8 | 0.1 |
| 3.0 | 0.6 | 72 | 10 |
| 5.0 | 0.9 | 400 | 128 |
| 7.0 | 1.0 | 480 | 144 |
| 10.0 | 1.0 | 530 | 176 |
| 15.0 | 0.8 | 80 | 12 |

EXAMPLE 12

The process of Example 1 was carried out, except that the master alloy was melted with the composition of 6.6 at % Nd, 0.5 at % Gd, 74.4 at % Fe, 10.0 at % Mo and 0.8 at % Ta. Gas-solid reaction was allowed to proceed in fluorine atmosphere of 1 atmospheric pressure at 300° C., and it was kept at this temperature for 2 hours. The fluoride magnetic powder thus obtained has the performance as shown in Table 17.

TABLE 17

| Temperature | $B_r$ (T) | $_iH_c$ (KA · m$^{-1}$) | $_bH_c$ (KA · m$^{-1}$) | $(BH)_{max}$ (KJ · m$^{-3}$) | $T_c$ (K) |
|---|---|---|---|---|---|
| Room temperature | 1.12 | 440 | 400 | 176 | 780 |

EXAMPLE 13

Nitride, fluoride or carbide interstitial alloys were obtained by using the process of Example 11 or 12. Their intrinsic performances are shown in Table 18 below.

TABLE 18

The alloy composition and the intrinsic performance of the nitride, fluoride, and carbide obtained in the present invention (the compositions are given in atomic percent)

| No. | Alloy Composition | Tc (K) | σ s (emu/g) 1.5K | σ s (emu/g) 300K | $H_A$ (KA · m$^{-1}$) 1.5K | $H_A$ (KA · m$^{-1}$) 300K |
|---|---|---|---|---|---|---|
| 1 | 6.7-Nd, 0.5-Er, 7.0-Mo, 6.3-Si, 76.7-Fe, 9.0-N | 760 | 142.4 | 136.4 | 8800 | 8000 |
| 2 | 6.7-Pr, 0.5-Dy, 10.5-Mo, 0.5-Mn, 75.3-Fe, 5.5-N | 650 | 141.7 | 120.9 | 13600 | 8800 |
| 3 | 6.2-Nd, 0.7-Dy, 9.3-Mo, 1.0-V, 74.0-Fe, 8.6-N | 710 | 147.5 | 142.8 | 10400 | 8200 |
| 4 | 5.9-Nd, 1.4-Ho, 6.8-Ti, 0.5-Mo, 67.6-Fe, 17.8-N | 790 | 157.5 | 144.0 | 10400 | 8400 |
| 5 | 6.7-Pr—Nd concentrated material, 0.3-Dy, 8.0-W, 1.0-Mo, 81.3-Fe, 13.0-N | 770 | 145.0 | 120.8 | 9600 | 8400 |
| 6 | 6.9-Nd, 0.3-Tb, 6.5-Mo, 1.0-Nb, 77.6-Fe, 8.0-C | 750 | 83.0 | 75.0 | 11200 | 9600 |
| 7 | 6.8-Pr, 0.5-Dy, 8.0-V, 1.0-Mo, 67.3-Fe, 12.5-N | 840 | 125.5 | 120.0 | 12000 | 9600 |
| 8 | 7.0-Pr, 0.7-Dy, 10.0-V, 1.0-Mo, 73.6-Fe, 7.7-F | 860 | 128.5 | 123.0 | 10400 | 8640 |

EXAMPLE 14

An alloys with the compositions of $Nd_{0.9}Y_{0.1}Fe_{10}Mo_{1.8}Ti_{0.2}$, $Nd_{0.9}Y_{0.1}Fe_{11}Mo_{0.1}Ti_{0.9}$, and $Nd_{0.9}Y_{0.1}Fe_{10.5}Mo_{0.2}V_{1.3}$ were melted, followed by treatment in hydrogen at 200–300° C. for 2–4 hours, and corresponding hydrides were obtained. The changes of the magnetic performance after hydrogenation are shown in Table 19 below.

TABLE 19

The comparison of magnetic performance before and after of hydrogenation

| Composition | σ s (μB/f.u.) | Δ $\mu_{Fe}/\mu_{Fe}$ (%) | $T_c$ (K) |
|---|---|---|---|
| $Nd_{0.9}Y_{0.1}Fe_{10}(Mo_{1.8}Ti_{0.2})_2$ | 9.89 | | 410 |
| $Nd_{0.9}Y_{0.1}Fe_{10}(Mo_{1.8}Ti_{0.2})_2H_z$ | 11.60 | 17.3 | 440 |
| $Nd_{0.9}Y_{0.1}Fe_{11}Ti_{0.8}Mo_{0.2}$ | 17.81 | | 530 |
| $Nd_{0.9}Y_{0.1}Fe_{11}Ti_{0.8}Mo_{0.2}H_z$ | 19.25 | 8.1 | 560 |
| $Nd_{0.9}Y_{0.1}Fe_{10.5}(V_{0.9}Mo_{0.1})_{1.5}$ | 15.40 | | 580 |
| $Nd_{0.9}Y_{0.1}Fe_{10.5}(V_{0.9}Mo_{0.1})_{1.5}H_z$ | 16.31 | 5.9 | 630 |

σ s (μB/f.u.) is the number of magnetic moment of each molecule at room temperature (measured in μB);
Δ $\mu_{Fe}/\mu_{Fe}$ (%) is the percent of increase of the magnetic moment for each iron atom after hydrogenation.

EXAMPLE 15

The process of Example 1 was carried out, except that in the process of preparation of sample A hydrogenation treatment was not conducted, instead nitrogenation treatment was directly carried out. Magnetic powders of sample A and sample B with the composition of $(Nd_{0.9}Dy_{0.1})_1Mo_{0.9}Ti_{0.1}Fe_{11}N_x$ were obtained. The permanent magnetism is shown in Table 20 below.

TABLE 20

The permanent magnetism of $(Nd_{0.9}Dy_{0.1})_1Mo_{0.9}Ti_{0.1}Fe_{11}N_x$ with or without hydrogenation treatment

| Sample | $B_r$ (T) | $_iH_c$ (KA · $m^{-1}$) | $(BH)_{max}$ (KJ · $m^{-3}$) |
|---|---|---|---|
| A | 0.95 | 384 | 120 |
| B | 1.08 | 440 | 172 |

EXAMPLE 16

Magnetic powders were produced by using mechanical alloying method. Specifically, metal powders with the composition of $(Nd_{0.9}Dy_{0.1})_8(Mo_{0.8}Nb_{0.2})_{12}Fe_{80}$, was prepared, and the product was treated with high-energy ball milling for 4 hours. Then, crystallization treatment was carried out in argon at 700° C., and was kept at this temperature for 1 hour. Thereafter, nitrogen treatment was carried out for 2 hours at 600° C. Finally, a high performance magnetic powder A was obtained.

The above-described process was carried out, except that the composition is $Nd_7Mo_{10}Fe_{77}$, and a magnetic powder B was obtained. The permanent magnetism of A and B are shown in Table 21 below.

TABLE 21

The permanent magnetic properties of A and B

| Sample | $B_r$ (T) | $_iH_c$ (KA · $m^{-1}$) | $(BH)_{max}$ (KJ · $m^{-3}$) |
|---|---|---|---|
| A | 0.9 | 10400 | 144 |
| B | 0.4 | 640 | 16 |

EXAMPLE 17

An alloy with the composition of $Nd_{4.1}Dy_{0.5}Fe_{83}Mo_{9.6}Nb_{2.5}$ was melted with the melt spinning method, cooled at the rate of 40 m/second, crystallization treatment was carried out at 900° C. Then, gas-solid reaction was allowed to proceed in nitrogen atmosphere at 500° C. for 4 hours. A high performance magnetic powder sample A was obtained.

The above-described process was carried out, except that the composition is $Nd_{4.6}Fe_{83}Mo_{12.1}$, and a magnetic powder B was obtained. The permanent magnetism of A and B are shown in Table 22 below.

TABLE 22

The permanent magnetic properties of A and B

| Sample | $B_r$ (T) | $_iH_c$ (KA · $m^{-1}$) | $(BH)_{max}$ (KJ · $m^{-3}$) |
|---|---|---|---|
| A | 0.95 | 704 | 160 |
| B | 0.45 | 448 | 18 |

EXAMPLE 18

The process of Example 1 was carried out, and the 1:12 nitride magnetic powder thus obtained was mixed with 3 wt % rubber resin as a binder. Then the mixture was oriented in a magnetic field of 15 kOe at a pressure of 8.0 t/$cm^2$. Thereafter, it was solidified at 200° C . The performance of the bonded magnet thus obtained is as follows: bHc=440 KA·$m^{-1}$, Br=0.72 T (BH)max=960 KJ·$m^{-3}$.

EXAMPLE 19

The process of Example 1 was carried out, and the 1:12 nitride magnetic powder thus obtained was mixed with nylon as a binder. Then injection molding was performed at 200° C., and orientating was performed in a 800 KA·$m^{-1}$ magnetic field. The performance of the bonded magnet thus obtained is as follows: Br=0.60 T. (BH)max=72 KJ·$m^{-3}$.

EXAMPLE 20

A composite magnet was produced by mixing the magnetic powder of the present invention and a ferrite (barium ferrite or strontium ferrite) magnetic powder. The composite magnet comprises 80% of the ferrite magnetic powder and 20% of the magnetic powder of the present invention, which keep the cost relatively low. The performance and the coercivity temperature coefficient of the composite magnet are as follows (Table 23):

TABLE 23

| Magnet | $B_r$ (T) | $_iH_c$ (KA · $m^{-1}$) | $_bH_c$ (KA · $m^{-1}$) | $(BH)_{max}$ (KJ · $m^{-3}$) | α iHc (%/° C.) |
|---|---|---|---|---|---|
| Ferrite | 0.34 | 192 | 136 | 160 | +0.2 |
| Composite magnet | 0.45 | 240 | 208 | 360 | −0.08 |

Figure 5:
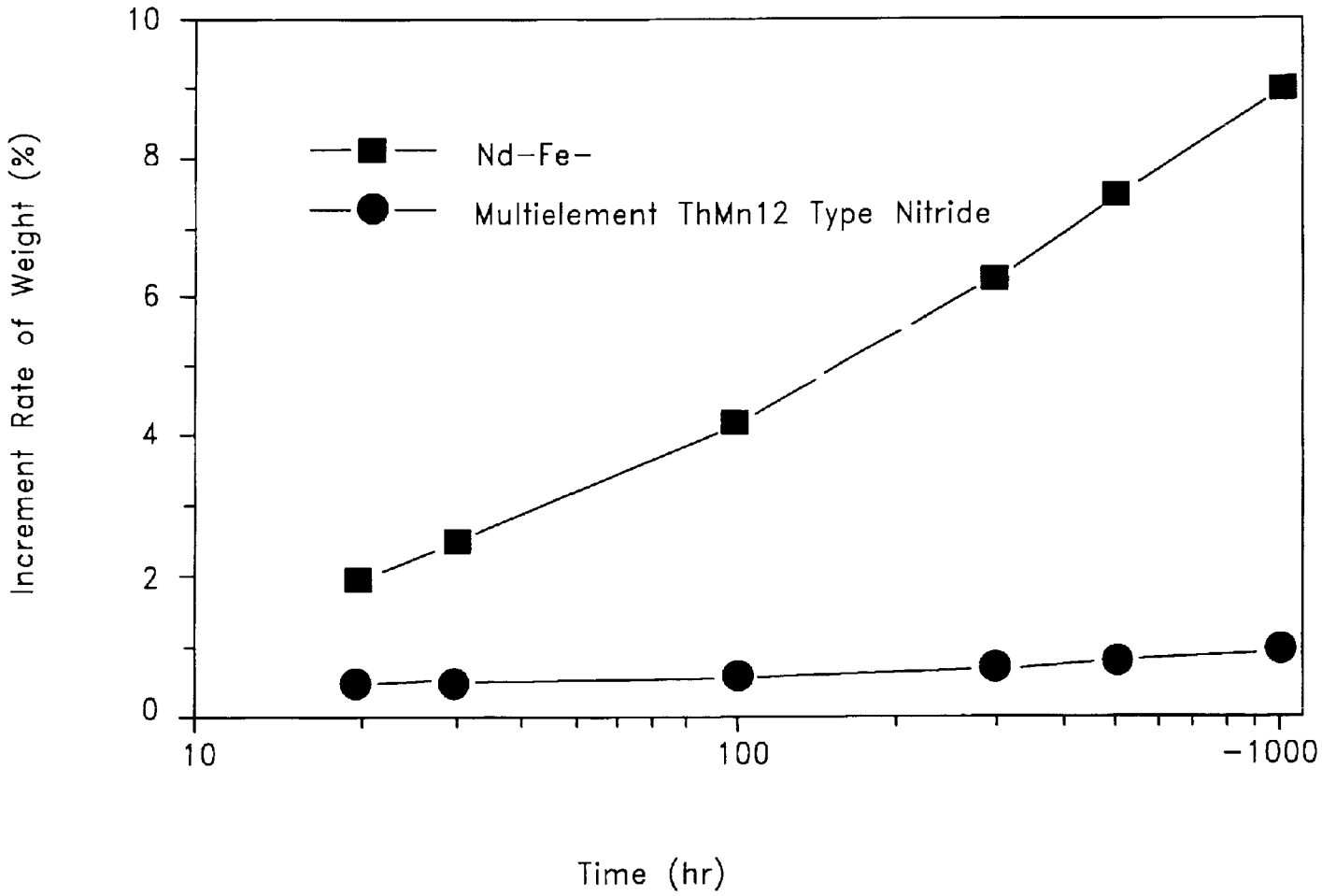
FIG. 5 shows the weight of multielement $ThMn_{12}$ type nitride as a function of time.

As can be seen from the results of the above Examples, the material of the present invention and the bonded magnet prepared by using the such materials have some advantages compared to Nd—Fe—B or Sm—Fe—N magnets. Firstly, it is more easier to produce an anisotropic magnetic powder with high magnetic energy product, which has prominent permanent magnetism not only at ambient temperatures, but also at low temperatures. For example, the remanence Br is greater than 1.2T (12 KG), the coercivity iHc is greater than 240 KA·$m^{-1}$(30 KOe), and the maximum magnetic energy product is up to 320 KJ·$m^{-3}$ (40 MGOe) at a temperature of 4.2 K. Secondly, it has high oxidation resistance at the temperatures of use, as is shown in FIG. 5. Thirdly, the high performance magnet according to the present invention has the advantage of low cost, because it comprises of relatively low content of rare earth elements, and the rare earth metals are selected from inexpensive rare earth metals, such as Pr, Nd or Pr—Nd concentrated material, meanwhile no expensive metals such as cobalt are included.

We claim:

1. A multielement rare earth-iron interstitial permanent magnetic material having a ThMn12 crystal structure and the following formula:

$$(R_{1-\alpha}R'_{\alpha})_x(Mo_{1-\beta}M_{\beta})_yFe_{100-x-y-z}I_z$$

wherein, R is a light rare earth element selected from Pr, Nd, or a mixture of Pr and Nd; R' is a heavy rare earth element selected from the group consisting of Gd, Tb, Dy, Ho, Er, and Y or a mixture of two or more thereof; $\alpha$ is from 0.01 to 0.14; x is an atomic percent from 4 to 15; M is an element selected from the group consisting of B, Ti, V, Cr, Mn, W, Si, Al, Ga, Nb, Sr, and Ta, or a mixture of two or more thereof; $\beta$ is from 0.01 to 0.98; y is an atomic percent from 3 to 20; l is an element selected from the group consisting of H, C, N, and F, or a mixture of two or more thereof; and z is an atomic percent from 5 to 20.

2. The multielement rare earth-iron interstitial permanent magnetic material according to claim 1, wherein, the atomic percent of the rare earth element x is from 6 to 10.

3. The multielement rare earth-iron interstitial permanent, magnetic material according to claim 1, wherein $\beta$ is from 0.01 to 0.40, and the atomic percent y is from 6 to 12.

4. The multielement rare earth-iron interstitial permanent magnetic material according to claim 1, wherein $\beta$ is from 0.80 to 0.98, and the atomic percent y is from 6 to 12.

* * * * *